United States Patent [19]

Wendel

[11] Patent Number: 4,651,259

[45] Date of Patent: Mar. 17, 1987

[54] REFLECTOR DEVICE

[76] Inventor: Heinrich Wendel, Stettiner Weg 2, D-6238 Hofheim/Ts., Fed. Rep. of Germany

[21] Appl. No.: 743,996

[22] PCT Filed: Oct. 3, 1983

[86] PCT No.: PCT/EP83/00256

§ 371 Date: May 31, 1985

§ 102(e) Date: May 31, 1985

[87] PCT Pub. No.: WO85/01566

PCT Pub. Date: Apr. 11, 1985

[51] Int. Cl.[4] ..... F21S 3/00

[52] U.S. Cl. ..... 362/217; 362/341; 362/346; 362/297; 362/1

[58] Field of Search ..... 362/217, 341, 346, 347, 362/349, 350, 1, 2, 805, 806, 16, 18, 140, 141, 216, 219, 232, 297, 296, 293, 260, 250, 247

[56] References Cited

U.S. PATENT DOCUMENTS

| | | | |
|---|---|---|---|
| 1,326,393 | 12/1919 | D'Humy | 362/2 |
| 3,201,576 | 8/1965 | Scott et al. | 362/1 |
| 3,239,660 | 3/1966 | Hall | 362/1 |
| 3,322,946 | 5/1967 | Cooper | 362/2 |
| 4,329,734 | 5/1982 | Latos | 362/346 |
| 4,389,699 | 6/1983 | Qualls | 362/297 |
| 4,423,469 | 12/1983 | Zerlaut et al. | 362/1 |
| 4,425,603 | 1/1984 | Courson | 362/297 |
| 4,499,529 | 2/1985 | Figueroa | 362/217 |

FOREIGN PATENT DOCUMENTS

| | | | |
|---|---|---|---|
| 2203825 | 8/1973 | Fed. Rep. of Germany | 362/217 |

*Primary Examiner*—Raymond A. Nelli
*Attorney, Agent, or Firm*—Jordan B. Bierman

[57] ABSTRACT

There is proposed a light reflector (10) which enables to modify the radiation emitted by an artificial source (12) so as to obtain a color temperature and a light intensity corresponding to that of natural light. To this effect, the reflector is comprised of a plurality of elongate prismatic bodies (14) rotating about their longitudinal axis. The faces of each prism present a different geometry with different optical characteristics.

12 Claims, 4 Drawing Figures

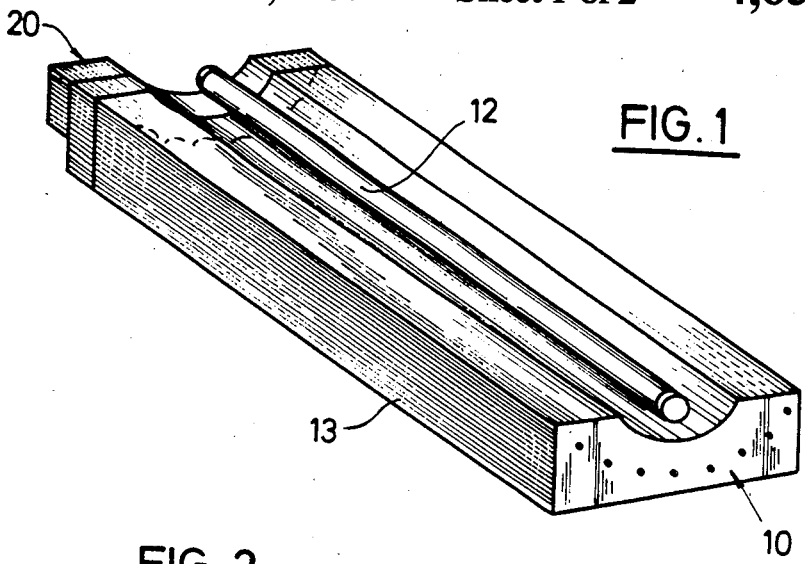
FIG. 1
FIG. 2
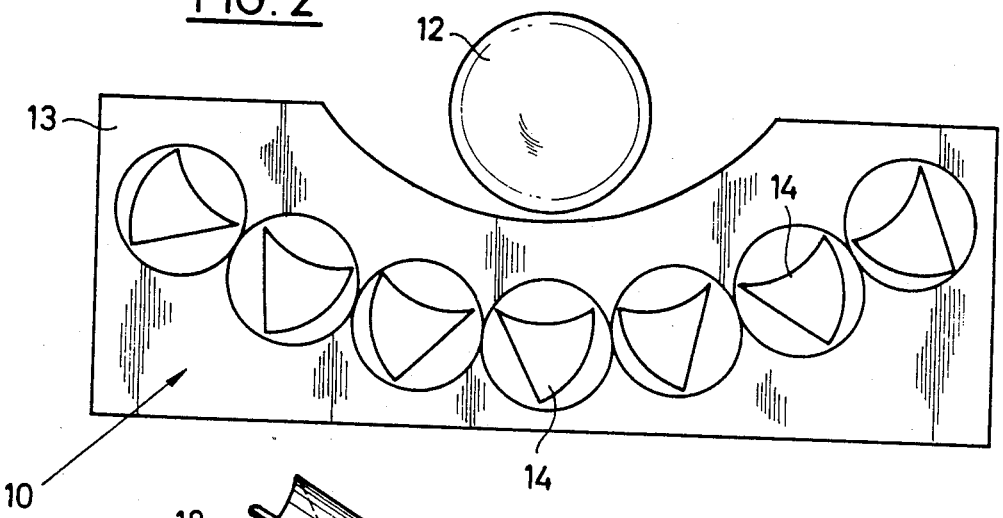
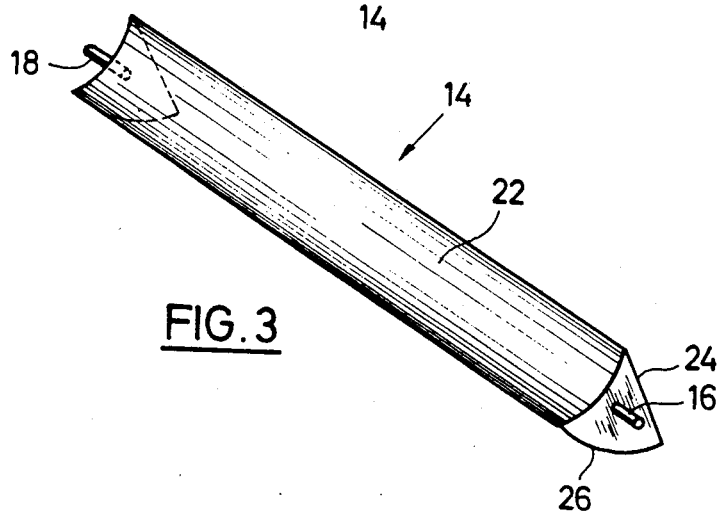
FIG. 3

REFLECTOR DEVICE

The invention relates to a reflector device for an artificial source of light having a spectrum corresponding to that of natural light, this artificial light source preferably being a fluorescent tube with reflector bodies that are adjustable and arranged at least partially around the light source.

A corresponding reflector arrangement is described in the German Registered Article No. DE-GM 18 03 911. There the reflector device is arranged in a street lamp in order to be able to adapt the luminous intensity distribution of each individual lamp to the respective street conditions by adjusting the individual reflector bodies formed like mirrors. Thereby the individual mirrors arranged on a ring around the lamp are adjusted once after mounting of the lamp in order to be adjusted to the desired street conditions, as mentioned above.

The British Specification No. GB-PS 97 40 relates to a reflector device for artificial light being composed of individual reflectors arranged in a ring or collar around a light source, which reflectors can be pivoted in such a manner that the lamp will either throw up the light to a ceiling or down to the floor of a room.

The U.S. Pat. No. 4,074,127 describes an illumination apparatus by which the light conditions of day and night can be simulated. Thereby the light conditions signify merely the value of light intensity. The simulation is effected in that a rod-shaped lamp is surrounded by a rotating reflector being provided with a slit, which reflector in accordance with the desired daytime to be simulated will not conceal the radiation delivered by the lamp or only partially conceal it or completely conceal it.

It is the object of the present invention to develop a reflector arrangement of the kind as mentioned at the outset in such a manner that the biologic effects of artificial light sources are improved to the effect that especially the colour temperature of the light coming from the light source will correspond to the daily routine of the natural day light, consequently can be simulated to the natural circadian rhythm.

This problem is solved by the invention in that each reflector unit is a body of prismatic configuration that can rotate about its longitudinal axis and is extending along the longitudinal axis of the light source, where at least two of the side faces of the body have a geometry differing from each other with different optical properties. Here by optical property or, resp. efficiency it is understood that especially the colour temperature of the reflected light is variable in order thus to correspond to the daily routine of the natural light. At the same time by adjusting the reflector bodies with respect to each other and the optional alignment of the differently reflecting side faces of the body according to the changing of the colour temperature, it is guaranteed that the luminous intensity is effected similarly to the daylight. To this effect the individual reflector bodies can be controlled synchronously, eventually by a preprogrammed control system so that the natural course os the daylight is simulated. Thereby the monotonous illumination intensity and colour temperature of the known artificial light sources is neutralized.

Consequently a natural metabolic and hormone economy is guaranteed for the human organism even then if it has to work under corresponding artificial light source conditions. Thereby the reflector bodies can be controlledly aligned to the light source in such a manner that even the passage of clouds or the like can be simulated in that e.g. shorter time intervals of less illumination intensity are reproduced.

According to an especially preferred embodiment the prism-shaped body is a triangular prism of which the three side faces are provided with a geometry differing from each other, where the optic efficiency of same is likewise designed differently. Thus after preferred characteristics of the invention one of the side faces is of convex shape and preferably has a structured surface. This convex side face, being red or at least has a red shading, is guaranteeing that the red portion of the light coming from the artificial light source is reflected more intensively while the ultra-violet portion of the spectrum is reflected at a less degree. By means of this red side face of the triangular prism of convex configuration it shall be guaranteed that the colour temperature is within the range of approx. 3500° Kelvin. By the convex shape it is also obvious that the reflection value is less as compared to flat or concave shaped surfaces.

According to the teaching of the invention the second side face is of flat configuration, has a yellow colour in order to thus reflect the ultra-violet radiation especially well and to increase the colour temperature fo a total of approx. 4500° Kelvin. By the flat design the illumination intensity of the light coming from the artificial light source can be increased for approx. 12%.

Finally the third side face is of concave configuration, consequently is having the highest value of reflection and appears silver coloured (this effect being reached by a special aluminum alloy, especially a magnesium-aluminum alloy) in order to thus maximize the light intensity on the one hand and on the other to increase the colour temperature to approx. 5400° Kelvin. Hereby at the same time the highest ultra-violet reflection of the reflector surfaces is guaranteed.

If the illumination intensity on the one side can be varied by the surface of the reflector body facing the light source up to ±25%, in addition this is also effected by the fact that the free inside distance between adjacent edges of reflector bodies arranged side by side is changed during the rotation process so that thereby the reflection value is automatically increased or, resp. decreased.

In another embodiment of the invention the direct radiation coming from the artificial light source can be additionally varied with respect to the illumination intensity and colour temperature by arranging foils and/or adjustable reflectors, e.g. like shutters.

Preferably the reflector device is designed for a fluorescent tube that can be operated with smoothed direct current, where during the operation a pole-changing of the lamp electrodes takes place. Thereby on the one hand the power consumption is reduced for roughly 37% as compared to the known fluorescent tubes being operated exclusively with alternate current (on the one side by increase of the lumen-watt power for 20%, and on the other side the power consumption is reduced for 17% as compared to other known connections), and on the other hand the biological effect of corresponding lamps is increased for approx. 300% in that the negative effects like e.g. optical flickering, electromagnetic interferences, etc. are eliminated. Thereby one should use especially a fluorescent tube being on the market under the name of True Lite, which is almost completely radiating the natural sunlight spectrum including the UVA and UVB portions.

Further details, advantages and characteristics of the invention will follow from the claims as well as the embodiment examples presented in the attached drawing, where FIG. 1 shows a fluorescent tube provided with a reflector arrangement according to the invention.

FIG. 2 is an enlarged view of the reflector arrangement according to FIG. 1,

FIG. 3 is a detail view of a reflector body according to FIG. 2, and

Figure 4:
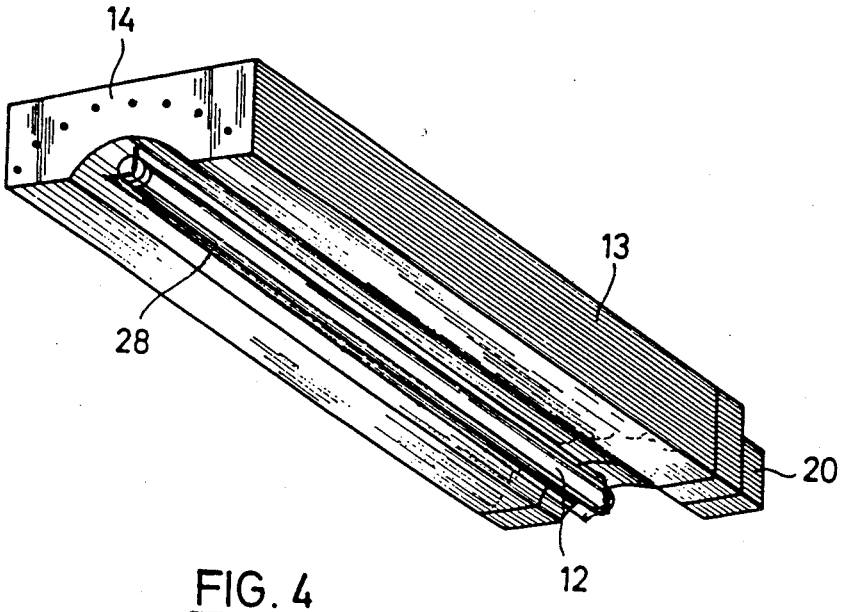
FIG. 4 is an alternative embodiment of a reflector device according to FIG. 1.

According to FIG. 1 an artificial light source, namely a fluorescent light tube 12 is shown surrounded by a reflector arrangement 10. Here the reflector device 10 is arranged in a lamp housing 13, which e.g. can be mounted on the ceiling of a room or can be suspending from that ceiling. According to FIG. 2 the reflector device 10 is composed at least of reflector bodies 14 arranged in a partial ring around the fluorescent light tube 12, e.g. on an imaginary cylinder jacket or another curved surface, in order to be able to modify and reflect the radiation coming from the fluorescent tube 12 in the desired extent regarding the colour temperature and the intensity of light. As especially made clear by FIG. 3, the reflector bodies are of prismatic configuration and having axle journals 16 and resp. 18 on their ends, by means of which these bodies can be mounted in bearings in the housing 13. Further from the axle bearings 16 and/or 18 there can be arranged e.g. frictional wheels or the like interacting with the adjacent reflector bodies in order to make possible a controlled and synchronous rotation of the reflector bodies 14, e.g. by means of a gearmotor mounted on a front face of the housing 13.

Thereby a gear can be arranged eventually between the individual frictional wheels, in order to be able to rotate the reflector bodies 14 at the same time in fact but still in the opposite sense. Thereby the control of the individual reflector bodies 14 can be pre-programmed in order to thus guarantee an alignment to the fluorescent light tube 12 at the desired extent, whereby finally the illumination intensity and the colour temperature of the emitted radiation are determined.

An essential characteristic of the invention is the design of each reflector body 14, which is preferably a triangular prism with side faces 22, 24, and 26 of different geometric configuration. In addition to an optical efficiency to be described in detail in the following that differs relative to the incident radiation, the different design of the side faces 22, 24, 26 shall guarantee that the radiation coming from the artificial light source, i.e. the fluorescent light tube 12, with respect to the illumination intensity and/or colour temperature is varied in such a manner that the daily routine of the natural light is simulated.

So the surface 22 regarding the fluorescent light tube 12 is of concave design, is silver-coloured preferably by means of a special aluminum alloy like e.g. a magnesium-aluminum alloy and presents optical properties that will guarantee that the illumination intensity is increased and a colour temperature of the radiation coming from the fluorescent tube 12 is adjusted to approximately 5400° Kelvin.

The side face 24 on the other hand is of flat design; and although it is likewise well reflecting the ultra-violet radiation, however, in a less portion than the convavely designed surface 22, and it sets the colour temperature of the emitted light to approximately 450° Kelvin. Further the flat surface is yellow and semi-shining. Preferably these properties are likewise obtained by a special aluminum alloy.

Finally the third surface 26 is of convex configuration and is more intensively reflecting the red portion of the light coming from the fluorescent light tube 12, where at the same time as compared to the surface 24, a reduced ultra-violet reflection takes place. The reflected light portion percepted from the surface 26 is the least due to the convex shape as compared to the reflection portions of the other surfaces 22 and 24. Further the convex surface is red and structured whereby at the same time the reflection value is decreased.

By aligning the individual reflector bodies 14 to the fluorescent light tube 12 it is thus guaranteed that the emitted light will equal the natural light of a daily routine so that the natural biologic-physiological rhythm is guaranteed. Concerning the dimensioning it should be mentioned that the distance of the edges from each other of each reflector body 14 being arranged on a ring is approximately 18 mm, where the distance between the surface of the fluorescent light tube and the next adjacent reflector body is approx. 40 to 50 mm. It should also be mentioned that instead of a triangular prism one can likewise use a hexagonal prism for a reflector body, where diametrically arranged side faces are of equal design as to their geometry and optical properties.

In still another embodiment of the invention the direct radiation coming from the fluorescent light tube can be additionnally influenced regarding illumination intensity and/or colour temperature by provided foils or reflectors 28, in order to be able eventually to even more precisely tune the emitted radiation to that of the natural daylight and its process.

Preferably the reflector device 10 according to the invention is meant for a fluorescent light tube 12 being supplied with a smoothed direct current. To this effect the fluorescent light tube can be supplied by a rectifier power source being connected to the public current supply, as it is described in the European Patent Application No. 006 2269 of the same applicant. Thereby the voltage coming from this rectifier connection is smoothed to a far extent so that among others, the electromagnetic interference fields appearing with the known fluorescent light tubes or the optical flickering are eliminated, whereby any physiologically negative effects on the persons working under a light coming from such fluorescent tubes are neutralized. As already described in the European Patent Application, thereby a periodically operating pole converter relay is series-connected to the rectifier connection in order to guarantee a periodic pole-changing during the operation whereby a cataphoresis is avoided.

I claim:

1. A reflector device for housing an artificial light source, preferably an enlongated straight flourescent tube (12) having an emission spectrum corresponding to that of natural daylight, wherein said housing is provided with adjustable reflector bodies arranged at least to partially surround said light source, characterized in that each reflector body (14) is of an elongated prismatic configuration of at least three sides, arranged to be selectively rotatable about its longitudinal axis in a manner parallel to the light-source long-axis, wherein at least two of the side faces (22,24,26) of said adjustable reflector bodies present a geometry differing from one another, characterized by different optical reflecting effencies.

2. Reflector device according to claim 1, characterized thereby that the body (14) is a triangular prism, of which the all side faces have a geometry differing from each other with different optical properties.

3. Reflector device according to claim 2, characterized thereby that the side faces (22, 24, 26) are of concave, flat and convex configuration.

4. Reflector device according to claim 3, characterized thereby that the convex-designed side face (26) is red, as well is intensifying the red portion and decreasing the ultra-violet portion that is reflected by the radiation coming from the fluorescent light tube.

5. Reflector device according to claim 3, characterized thereby that the flat-designed side face (24) is preferably yellow and semi-shining, reflects the ultra-violet portion of the radiation coming from the light source (12).

6. Reflector device according to claim 3, characterized thereby that the concave side face (22) as compared to the other faces (24, 26) is most strongly reflecting the ultra-violet portion of the radiation emanating from the light source (12).

7. Reflector device according to claim 6, characterized thereby that the concave-designed side face (22) is covered with an aluminum-magnesium alloy.

8. Reflector device according to claim 3, characterized thereby that the color temperature of the light source (12) radiation reflected by the convex side face (26) is approximately 3500° Kelvin preferably, that of the flat side face (24) preferably approx. 4500° Kelvin, and that of the concave side face (22) preferably approx. 5400° Kelvin.

9. Reflector device according to claim 1, characterized thereby that by the adjustment of the reflector bodies (14) of the reflector device (10) with respect to the light source (12), the colour temperature of same can be continuously varied between approx. 3500° and 5400° Kelvin and its illumination intensity preferably for ±25%.

10. Reflector device according to claim 1, characterized in that means are provided for adjusting the reflector bodies (14) of the reflector device (10) with respect to each other and to the light source (12) in such a manner that the light intensity and colour temperature of the radiation perceived from the light source will equal the natural daylight and its progress.

11. Reflector device according to claim 1, characterized thereby that the reflector device in addition is comprising at least one of foils and adjustable reflectors in order to influence the direct radiation coming from the light source (12).

12. Reflector device according to claim 8, characterized in that means are provided for adjusting the reflector bodies (14) of the reflector device (10) with respect to each other and to the light source (12) in such a manner that the light intensity and colour temperature of the radiation perceived from the light source will equal the natural daylight and its progress.

* * * * *